US006450417B1

(12) United States Patent
Gipson et al.

(10) Patent No.: US 6,450,417 B1
(45) **Date of Patent: *Sep. 17, 2002**

(54) ULTRASONIC LIQUID FUEL INJECTION APPARATUS AND METHOD

(75) Inventors: Lamar Heath Gipson, Acworth, GA (US); Bernard Cohen, Berkeley Lake, GA (US); Lee Kirby Jameson, Roswell, GA (US)

(73) Assignee: Kimberly-Clark Worldwide Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/664,009

(22) Filed: Sep. 18, 2000

Related U.S. Application Data

(63) Continuation of application No. 08/576,522, filed on Dec. 21, 1995, now abandoned.

(51) Int. Cl.[7] ..... B05B 1/08; F02D 1/06

(52) U.S. Cl. ..... 239/5; 239/102.1; 239/102.2; 137/13; 137/828; 251/129.06

(58) Field of Search ..... 239/5, 102.1, 102.2; 137/13, 828; 251/129.06

(56) References Cited

U.S. PATENT DOCUMENTS

| | | | | |
|---|---|---|---|---|
| 2,484,012 | A | 10/1949 | Calhoun, Jr. | 18/54 |
| 2,484,014 | A | 10/1949 | Peterson et al. | 18/54 |
| 2,745,136 | A | 5/1956 | Deboutteville | 18/8 |
| 3,016,599 | A | 1/1962 | Perry, Jr. | 28/78 |
| 3,042,481 | A | 7/1962 | Coggeshall | 18/54 |
| 3,071,809 | A | 1/1963 | Lerch | 18/13 |
| 3,194,855 | A | 7/1965 | Jones et al. | 264/70 |
| 3,203,215 | A | 8/1965 | Jones | 72/253 |
| 3,233,012 | A | 2/1966 | Bodine, Jr. | 264/23 |
| 3,285,442 | A | 11/1966 | Tigner | 264/70 |

(List continued on next page.)

FOREIGN PATENT DOCUMENTS

| | | |
|---|---|---|
| DE | 177 045 | 4/1905 |
| DE | 2 734 818 A1 | 2/1978 |
| DE | 3 010 985 A1 | 1/1981 |
| EP | 0 036 617 A2 | 3/1981 |
| EP | 0 165 407 A2 | 12/1985 |
| EP | 0 202 100 A1 | 11/1986 |

(List continued on next page.)

OTHER PUBLICATIONS

JP 56–144214 (Abstract); Patentee; Idemitsu Kosan Co. Ltd.; Nov. 10, 1981.
JP 57–051441(Abstract); Assignee: Imperial Chem Inds PLC; Mar. 26, 1982.
JP 57–078967 (Abstract); Assignee: Toshiba Corp.; May 17, 1982.
JP 57–099327 (Abstract); Patentee: Toshiba Corp.; Jun. 21, 1982.

(List continued on next page.)

*Primary Examiner*—Robin O. Evans
(74) *Attorney, Agent, or Firm*—Scott B. Garrison

(57) ABSTRACT

An ultrasonic apparatus and a method for injecting a pressurized liquid fuel by applying ultrasonic energy to a portion of the pressurized liquid fuel. The apparatus includes a die housing which defines a chamber adapted to receive a pressurized liquid and a means for applying ultrasonic energy to a portion of the pressurized liquid. The die housing further includes an inlet adapted to supply the chamber with the pressurized liquid, and an exit orifice defined by the walls of a die tip. The exit orifice is adapted to receive the pressurized liquid from the chamber and pass the liquid out of the die housing. When the means for applying ultrasonic energy is excited, it applies ultrasonic energy to the pressurized liquid without applying ultrasonic energy to the die tip. The method involves supplying a pressurized liquid to the foregoing apparatus, applying ultrasonic energy to the pressurized liquid but not the die tip while the exit orifice receives pressurized liquid from the chamber, and passing the pressurized liquid out of the exit orifice in the die tip.

34 Claims, 5 Drawing Sheets

U.S. PATENT DOCUMENTS

| | | | | |
|---|---|---|---|---|
| 3,341,394 | A | 9/1967 | Kinney | 161/72 |
| 3,463,321 | A | 8/1969 | Van Ingen | 210/388 |
| 3,619,429 | A | 11/1971 | Torigai et al. | 264/23 |
| 3,655,862 | A | 4/1972 | Dorschner et al. | 264/290 |
| 3,668,185 | A | 6/1972 | Boutsicaris | 260/75 HN |
| 3,679,132 | A | 7/1972 | Vehe et al. | 239/4 |
| 3,692,618 | A | 9/1972 | Dorschner et al. | 161/72 |
| 3,704,198 | A | 11/1972 | Prentice | 161/148 |
| 3,705,068 | A | 12/1972 | Dobo et al. | 156/441 |
| 3,715,104 | A | 2/1973 | Cottell | 259/1 R |
| 3,729,138 | A | 4/1973 | Tysk | 239/102 |
| 3,755,527 | A | 8/1973 | Keller et al. | 264/210 |
| 3,802,817 | A | 4/1974 | Matsuki et al. | 425/66 |
| 3,819,116 | A | 6/1974 | Goodinge et al. | 239/102 |
| 3,849,241 | A | 11/1974 | Butin et al. | 161/169 |
| 3,853,651 | A | 12/1974 | Porte | 156/73.6 |
| 3,884,417 | A | 5/1975 | Sheffield et al. | 239/102 |
| 3,949,127 | A | 4/1976 | Ostermeier et al. | 428/137 |
| 3,949,938 | A | 4/1976 | Goodinge | 239/102 |
| 3,977,604 | A | 8/1976 | Yokoyama et al. | 239/102 |
| 3,978,185 | A | 8/1976 | Buntin et al. | 264/93 |
| 4,013,223 | A | 3/1977 | Martin | 239/102 |
| 4,038,348 | A | 7/1977 | Kompanek | 261/36 |
| 4,048,963 | A | 9/1977 | Cottell | 123/25 R |
| 4,064,605 | A | 12/1977 | Akiyama et al. | 28/103 |
| 4,067,496 | A | 1/1978 | Martin | 239/102 |
| 4,091,140 | A | 5/1978 | Harmon | 428/288 |
| 4,100,319 | A | 7/1978 | Schwartz | 428/171 |
| 4,100,324 | A | 7/1978 | Anderson et al. | 428/288 |
| 4,100,798 | A | 7/1978 | Nilsson et al. | 73/194 |
| 4,105,004 | A | 8/1978 | Asai et al. | 123/141 |
| 4,118,531 | A | 10/1978 | Hauser | 428/224 |
| 4,121,549 | A | 10/1978 | Martin et al. | 123/32 |
| 4,127,087 | A | 11/1978 | Caves | 123/32 |
| 4,127,624 | A | 11/1978 | Keller et al. | 264/23 |
| 4,134,931 | A | 1/1979 | Hayes, Jr. et al. | 260/897 B |
| 4,159,703 | A | 7/1979 | Mayer | 123/139 AW |
| 4,198,461 | A | 4/1980 | Keller et al. | 428/288 |
| 4,218,221 | A | 8/1980 | Cottell | 44/51 |
| 4,239,720 | A | 12/1980 | Gerlach et al. | 264/147 |
| 4,288,398 | A | 9/1981 | Lemelson | 264/23 |
| 4,340,563 | A | 7/1982 | Appel et al. | 254/518 |
| 4,372,491 | A | 2/1983 | Fishgal | 239/102 |
| 4,389,999 | A | 6/1983 | Jaqua | 123/536 |
| 4,405,297 | A | 9/1983 | Appel et al. | 425/72 S |
| 4,418,672 | A | 12/1983 | Müller | 123/478 |
| 4,434,204 | A | 2/1984 | Hartman et al. | 428/198 |
| 4,466,571 | A | 8/1984 | Mühlbauer | 239/101 |
| 4,496,101 | A | 1/1985 | Northman | 239/102 |
| 4,500,280 | A | 2/1985 | Astier et al. | 425/569 |
| 4,521,364 | A | 6/1985 | Norota et al. | 264/176 F |
| 4,526,733 | A | 7/1985 | Lau | 264/12 |
| 4,529,792 | A | 7/1985 | Barrows | 528/291 |
| 4,563,993 | A | 1/1986 | Yamauchi et al. | 123/478 |
| 4,576,136 | A | 3/1986 | Yamauchi et al. | 123/590 |
| 4,590,915 | A | 5/1986 | Yamauchi et al. | 123/590 |
| 4,627,811 | A | 12/1986 | Greiser et al. | 425/72 S |
| 4,644,045 | A | 2/1987 | Fowells | 526/348 |
| 4,663,220 | A | 5/1987 | Wisneski et al. | 428/221 |
| 4,665,877 | A | 5/1987 | Manaka et al. | 123/472 |
| 4,715,353 | A | 12/1987 | Koike et al. | 123/590 |
| 4,716,879 | A | 1/1988 | Takayama et al. | 123/590 |
| 4,726,522 | A | 2/1988 | Kobubo et al. | 239/102.2 |
| 4,726,523 | A | 2/1988 | Kokubo et al. | 239/102.2 |
| 4,726,524 | A | 2/1988 | Ishikawa et al. | 239/102.2 |
| 4,726,525 | A | 2/1988 | Yonekawa et al. | 239/102.2 |
| 4,742,810 | A | 5/1988 | Anders et al. | 123/538 |
| 4,756,478 | A | 7/1988 | Endo et al. | 239/102.2 |
| 4,793,954 | A | 12/1988 | Lee et al. | 264/23 |
| 4,815,192 | A | 3/1989 | Usui et al. | 29/509 |
| 4,852,668 | A | 8/1989 | Dickinson, III et al. | 175/67 |
| 4,974,780 | A | 12/1990 | Nakamura et al. | 239/102.2 |
| 4,986,248 | A | 1/1991 | Kobayashi et al. | 123/590 |
| 4,995,367 | A | 2/1991 | Yamauchi et al. | 123/494 |
| 5,017,311 | A | 5/1991 | Furusawa et al. | 264/23 |
| 5,068,068 | A | 11/1991 | Furusawa et al. | 264/23 |
| 5,110,286 | A | 5/1992 | Gaysert et al. | 431/208 |
| 5,112,206 | A | 5/1992 | Stewart | 425/114 |
| 5,114,633 | A | 5/1992 | Stewart | 264/23 |
| 5,154,347 | A | 10/1992 | Vijay | 239/4 |
| 5,160,746 | A | 11/1992 | Dodge, II et al. | 425/7 |
| 5,169,067 | A | 12/1992 | Matsusaka et al. | 239/102.2 |
| 5,179,923 | A | 1/1993 | Tsurutani et al. | 123/435 |
| 5,226,364 | A | 7/1993 | Fadner | 101/366 |
| 5,269,981 | A | 12/1993 | Jameson et al. | 264/23 |
| 5,330,100 | A | 7/1994 | Malinowski | 239/102.2 |
| 5,382,400 | A | 1/1995 | Pike et al. | 264/168 |
| 5,801,106 | A | 9/1998 | Jameson | 442/334 |
| 5,803,106 | A | 9/1998 | Cohen et al. | 137/13 |
| 6,010,592 | A | 1/2000 | Jameson et al. | 156/379.6 |

FOREIGN PATENT DOCUMENTS

| | | | |
|---|---|---|---|
| EP | 0 202 381 | A1 | 11/1986 |
| EP | 0 202 844 | B1 | 11/1986 |
| EP | 0 235 603 | A2 | 9/1987 |
| EP | 0 251 524 | B1 | 1/1988 |
| EP | 0 300 198 | A1 | 1/1989 |
| EP | 0 303 998 | A1 | 2/1989 |
| EP | 0 465 660 | A1 | 1/1992 |
| EP | 0 495 506 | B1 | 7/1992 |
| EP | 0 303 889 | B1 | 6/1993 |
| EP | 0 644 280 | B1 | 3/1995 |
| GB | 865707 | | 4/1961 |
| GB | 1 263 159 | | 2/1972 |
| GB | 1 382 828 | | 2/1975 |
| GB | 1 415 539 | | 11/1975 |
| GB | 1 432 760 | | 4/1976 |
| GB | 1 555 766 | | 11/1979 |
| GB | 2 077 351 | A | 12/1981 |
| GB | 2 082 251 | A | 3/1982 |
| GB | 2 274 877 | A | 8/1994 |
| JP | 49-133613 | | 12/1974 |
| RU | 1812332 | A1 | 4/1993 |
| SU | 468948 | | 7/1975 |
| SU | 449504 | | 11/1975 |
| WO | 93/01404 | | 1/1993 |
| WO | 96/00318 | | 1/1996 |

OTHER PUBLICATIONS

JP 62–160110 (Abstract); Assignee: Fuji Photo Film Co. Ltd.; Jul. 16, 1987.

CZ 9006657 (Abstract); Assignee: Vysoka Skola Dopravy Spojov;Jul. 14, 1993.

DL 134 052 (Abstract); Assignee: Plast & Elastverarb VEB; Feb. 7, 1979.

DL 138 523 (Abstract); Assignee: VEB Leuna–Werk W. Ulbrich; Nov. 7, 1979.

DE 2555839 A1 (Abstract); Assignee: Plessey Handel Investment AG; Jun. 16, 1976.

DE 3912524 A1 (Abstract); Assignee: Deut Forsch Luft Raumfahrt EV; Nov. 2, 1989.

SU 386 977 (Abstract); Assignee: Coke Chem Equip Des Bur; Oct. 3, 1973.

SU 532 529 (Abstract); Assignee: Mosc Chem Eng Inst; May 19, 1977.

SU 706 250 (Abstract); Assignee: Ilyukhin Yu D; Dec. 31, 1979.
SU 1 479 464 (Abstract); Assignee: Moscow Mendeleev Chem.; May 15 1989.
"Superfine Thermoplastic Fibers" by Van A. Wente, Industrial and Engineering Chemistry, vol. 48, No. 8, Aug. 1956, pp. 1342–1346.
"Manufacture of Superfine Organic Fibers" by V. A. Wente et al., NRL Report 4364, May 25, 1954, pp. ii and 1–15.
"Melt Blowing—A One–Step Web Process for New Nonwoven Products" by Robert R. Buntin et al., Tappi, vol. 56, No. 4, Apr. 1973, pp. 74–77.
"Ultrasonics", Encyclopedia of Chemical Technology, 3rd ed., vol. 23, pp. 462–479.
"Degassing of Liquids", Physical Principles of Ultrasonic Technology, vol. 1, contents and pp. 376–509.
"Fundamental Principles of Polymerization" by F. F. D'Alelio, John Wiley & Sons Inc. Dec. 1952, pp. 100–101.

ULTRASONIC LIQUID FUEL INJECTION APPARATUS AND METHOD

This application is a continuation of application Ser. No. 08/576,522 entitled Ultrasonic Liquid Fuel Injection Apparatus and Method filed in the U.S. Patent and Trademark Office on Dec. 21, 1995, which has been abandoned, the entirety of which is hereby incorporated by reference.

BACKGROUND OF THE INVENTION

The present invention relates to an ultrasonic liquid fuel injection apparatus. The present invention also relates to a method of ultrasonically injecting liquid fuel.

SUMMARY OF THE INVENTION

The present invention provides an ultrasonic apparatus and a method for injecting a pressurized liquid fuel by applying ultrasonic energy to a portion of the pressurized liquid fuel so that the liquid fuel can be injected into an internal combustion engine. The apparatus includes a die housing which defines a chamber adapted to receive a pressurized liquid fuel and a means for applying ultrasonic energy to a portion of the pressurized liquid fuel. The die housing includes a chamber adapted to receive the pressurized liquid fuel, an inlet adapted to supply the chamber with the pressurized liquid fuel, and an exit orifice (or a plurality of exit orifices) defined by the walls of a die tip and adapted to receive the pressurized liquid fuel from the chamber and pass the liquid fuel out of the die housing. The means for applying ultrasonic energy is located within the chamber and may be, for example, an immersed ultrasonic horn. According to the invention, the means for applying ultrasonic energy is located within the chamber in a manner such that no ultrasonic energy is applied to the die tip (i.e., the walls of the die tip defining the exit orifice).

In one embodiment of the ultrasonic fuel injector apparatus, the die housing may have a first end and a second end and the exit orifice is adapted to receive the pressurized liquid fuel from the chamber and pass the pressurized liquid fuel along a first axis. The means for applying ultrasonic energy to a portion of the pressurized liquid fuel is an ultrasonic horn having a first end and a second end. The horn is adapted, upon excitation by ultrasonic energy, to have a node and a longitudinal mechanical excitation axis. The horn is located in the second end of the die housing in a manner such that the first end of the horn is located outside of the die housing and the second end is located inside the die housing, within the chamber, and is in close proximity to the exit orifice. Alternatively, both the first end and the second end of the horn may be located inside the die housing.

The longitudinal excitation axis of the ultrasonic horn desirably will be substantially parallel with the first axis. Furthermore, the second end of the horn desirably will have a cross-sectional area approximately the same as or greater than a minimum area which encompasses all exit orifices in the die housing.

The ultrasonic fuel injector apparatus may have an ultrasonic horn having a vibrator means coupled to the first end of the horn. The vibrator means may be a piezoelectric transducer or a magnetostrictive transducer. The transducer may be coupled directly to the horn or by means of an elongated waveguide. The elongated waveguide may have any desired input:output mechanical excitation ratio, although ratios of 1:1 and 1:1.5 are typical for many applications. The ultrasonic energy typically will have a frequency of from about 15 kHz to about 500 kHz, although other frequencies are contemplated.

In an embodiment of the present invention, the ultrasonic horn may be composed of a magnetostrictive material. The horn may be surrounded by a coil (which may be immersed in the liquid) capable of inducing a signal into the magnetostrictive material causing it to vibrate at ultrasonic frequencies. In such cases, the ultrasonic horn may be simultaneously the transducer and the means for applying ultrasonic energy to the multi-component liquid.

The apparatus includes a die housing which defines a chamber adapted to receive a pressurized liquid and a means for applying ultrasonic energy to a portion of the pressurized liquid. The die housing includes a chamber adapted to receive the pressurized liquid, an inlet adapted to supply the chamber with the pressurized liquid, and an exit orifice (or a plurality of exit orifices) defined by the walls of a die tip, the exit orifice being adapted to receive the pressurized liquid from the chamber and pass the liquid out of the die housing. Generally speaking, the means for applying ultrasonic energy is located within the chamber. For example, the means for applying ultrasonic energy may be an immersed ultrasonic horn. According to the invention, the means for applying ultrasonic energy is located within the chamber in a manner such that no ultrasonic energy is applied to the die tip (i.e., the walls of the die tip defining the exit orifice).

In one embodiment of the present invention, the die housing may have a first end and a second end. One end of the die housing forms a die tip having walls that define an exit orifice which is adapted to receive a pressurized liquid from the chamber and pass the pressurized liquid along a first axis. The means for applying ultrasonic energy to a portion of the pressurized liquid is an ultrasonic horn having a first end and a second end. The horn is adapted, upon excitation by ultrasonic energy, to have a node and a longitudinal mechanical excitation axis. The horn is located in the second end of the die housing in a manner such that the first end of the horn is located outside of the die housing and the second end is located inside the die housing, within the chamber, and is in close proximity to the exit orifice.

The longitudinal excitation axis of the ultrasonic horn desirably will be substantially parallel with the first axis. Furthermore, the second end of the horn desirably will have a cross-sectional area approximately the same as or greater than a minimum area which encompasses all exit orifices in the die housing. Upon excitation by ultrasonic energy, the ultrasonic horn is adapted to apply ultrasonic energy to the pressurized liquid within the chamber (defined by the die housing) but not to the die tip which has walls that define the exit orifice.

The present invention contemplates the use of an ultrasonic horn having a vibrator means coupled to the first end of the horn. The vibrator means may be a piezoelectric transducer or a magnetostrictive transducer. The transducer may be coupled directly to the horn or by means of an elongated waveguide. The elongated waveguide may have any desired input:output mechanical excitation ratio, although ratios of 1:1 and 1:1.5 are typical for many applications. The ultrasonic energy typically will have a frequency of from about 15 kHz to about 500 kHz, although other frequencies are contemplated. In an embodiment of the present invention, the ultrasonic horn may be composed of a magnetostrictive material and be surrounded by a coil (which may be immersed in the liquid) capable of inducing a signal into the magnetostrictive material causing it to vibrate at ultrasonic frequencies. In such case, the ultrasonic horn may be simultaneously the transducer and the means for applying ultrasonic energy to the multi-component liquid.

In an aspect of the present invention, the exit orifice may have a diameter of less than about 0.1 inch (2.54 mm). For example, the exit orifice may have a diameter of from about 0.0001 to about 0.1 inch (0.00254 to 2.54 mm) As a further example, the exit orifice may have a diameter of from about 0.001 to about 0.01 inch (0.0254 to 0.254 mm).

According to the invention, the exit orifice may be a single exit orifice or a plurality of exit orifices. The exit orifice may be an exit capillary. The exit capillary may have a length to diameter ratio (L/D ratio) of ranging from about 4:1 to about 10:1. Of course, the exit capillary may have a L/D ratio of less than 4:1 or greater than 10:1.

In an embodiment of the invention, the exit orifice is self-cleaning. In another embodiment of the invention, the apparatus may be adapted to emulsify a pressurized multi-component liquid. In another embodiment of the invention, the apparatus may be adapted to produce a spray of liquid. For example, the apparatus may be adapted to produce an atomized spray of liquid. Alternatively and/or additionally, the apparatus may be adapted to produce a uniform, cone-shaped spray of liquid. In yet another embodiment of the invention, the apparatus may be adapted to cavitate a pressurized liquid.

The apparatus and method may be used in fuel injectors for liquid-fueled combustors. Exemplary combustors include, but are not limited to, boilers, kilns, industrial and domestic furnaces, incinerators. The apparatus and method may be used in fuel injectors for discontinuous flow internal combustion engines (e.g., reciprocating piston gasoline and diesel engines).

The apparatus and method may also be used in fuel injectors for continuous flow engines (e.g., Sterling-cycle heat engines and gas turbine engines).

The apparatus and method of the present invention may be used to emulsify multi-component liquid fuels as well as liquid fuel additives and contaminants.

DETAILED DESCRIPTION OF THE INVENTION

As used herein, the term "liquid" refers to an amorphous (noncrystalline) form of matter intermediate between gases and solids, in which the molecules are much more highly concentrated than in gases, but much less concentrated than in solids. A liquid may have a single component or may be made of multiple components. The components may be other liquids, solid and/or gases. For example, Characteristic of liquids is their ability to flow as a result of an applied force. Liquids that flow immediately upon application of force and for which the rate of flow is directly proportional to the force applied are generally referred to as Newtonian liquids. Some liquids have abnormal flow response when force is applied and exhibit non-Newtonian flow properties.

As used herein, the term "node" means the point on the longitudinal excitation axis of the ultrasonic horn at which no longitudinal motion of the horn occurs upon excitation by ultrasonic energy. The node sometimes is referred in the art, as well as in this specification, as the nodal point.

The term "close proximity" is used herein in a qualitative sense only. That is, the term is used to mean that the means for applying ultrasonic energy is sufficiently close to the exit orifice (e.g., extrusion orifice) to apply the ultrasonic energy primarily to the liquid (e.g., pressurized liquid fuel) passing into the exit orifice (e.g., extrusion orifice). The term is not used in the sense of defining specific distances from the extrusion orifice.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, solvents, particulates and materials added to enhance processability of the composition.

Generally speaking, the apparatus of the present invention includes a die housing and a means for applying ultrasonic energy to a portion of a pressurized liquid fuel (e.g., hydrocarbon oils, hydrocarbon emulsions, alcohols, combustible slurries, suspensions or the like). The die housing defines a chamber adapted to receive the pressurized liquid, an inlet (e.g., inlet orifice) adapted to supply the chamber with the pressurized liquid, and an exit orifice (e.g., extrusion orifice) adapted to receive the pressurized liquid from the chamber and pass the liquid out of the exit orifice of the die housing. The means for applying ultrasonic energy is located within the chamber. For example, the means for applying ultrasonic energy can be located partially within the chamber or the means for applying ultrasonic energy can be located entirely within the chamber.

Figure 1:
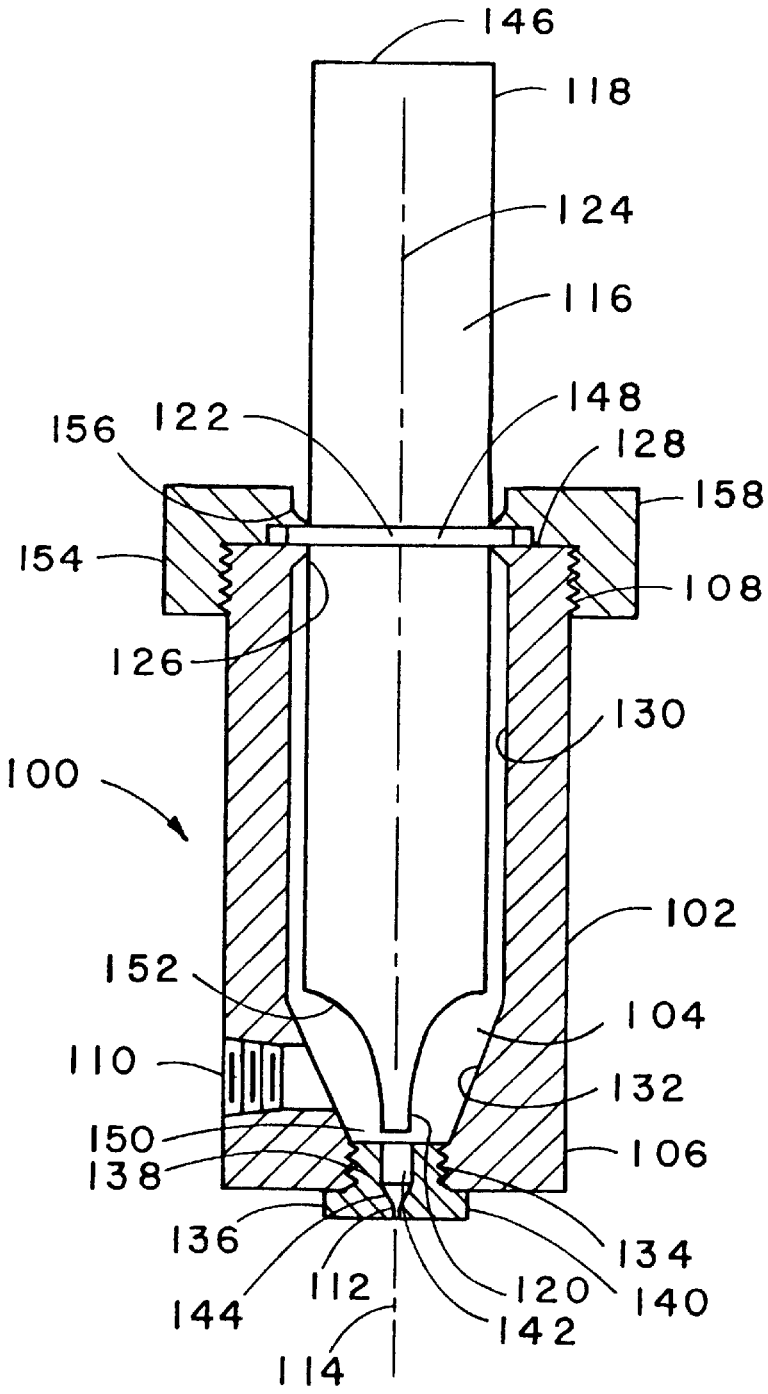
FIG. 1 is a diagrammatic cross-sectional representation of one embodiment of the apparatus of the present invention.

Referring now to FIG. 1, there is shown, not necessarily to scale, and exemplary apparatus for injecting a pressurized liquid fuel into an internal combustion engine. The apparatus 100 includes a die housing 102 which defines a chamber 104 adapted to receive a pressurized liquid fuel. The die housing 102 has a first end 106 and a second end 108. The die housing 102 also has an inlet 110 (e.g., inlet orifice) adapted to supply the chamber 104 with the pressurized liquid. An exit orifice 112 (which may also be referred to as an extrusion orifice) is located in the first end 106 of the die housing 102; it is adapted to receive the pressurized liquid from the chamber 104 and pass the liquid out of the die housing 102 along a first axis 114. An ultrasonic horn 116 is located in the second end 108 of the die housing 102. The ultrasonic horn has a first end 118 and a second end 120. The horn 116 is located in the second end 108 of the die housing 102 in a manner such that the first end 118 of the horn 116 is located outside of the die housing 102 and the second end 120 of the horn 116 is located inside the die housing 102, within the chamber 104, and is in close proximity to the exit orifice 112. The horn 116 is adapted, upon excitation by ultrasonic energy, to have a nodal point 122 and a longitudinal mechanical excitation axis 124. Desirably, the first axis 114 and the mechanical excitation axis 124 will be substantially parallel. More desirably, the first axis 114 and the mechanical excitation axis 124 will substantially coincide, as shown in FIG. 1.

The size and shape of the apparatus of the present invention can vary widely, depending, at least in part, on the number and arrangement of exit orifices (e.g., extrusion orifices) and the operating frequency of the means for applying ultrasonic energy. For example, the die housing may be cylindrical, rectangular, or any other shape. Moreover, the die housing may have a single exit orifice or a plurality of exit orifices. A plurality of exit orifices may be arranged in a pattern, including but not limited to, a linear or a circular pattern.

The means for applying ultrasonic energy is located within the chamber, typically at least partially surrounded by the pressurized liquid. Such means is adapted to apply the ultrasonic energy to the pressurized liquid as it passes into the exit orifice. Stated differently, such means is adapted to apply ultrasonic energy to a portion of the pressurized liquid in the vicinity of each exit orifice. Such means may be located completely or partially within the chamber.

When the means for applying ultrasonic energy is an ultrasonic horn, the horn conveniently extends through the die housing, such as through the first end of the housing as identified in FIG. 1. However, the present invention comprehends other configurations. For example, the horn may extend through a wall of the die housing, rather than through an end. Moreover, neither the first axis nor the longitudinal excitation axis of the horn need to be vertical. If desired, the longitudinal mechanical excitation axis of the horn may be at an angle to the first axis. Nevertheless, the longitudinal mechanical excitation axis of the ultrasonic horn desirably will be substantially parallel with the first axis. More desirably, the longitudinal mechanical excitation axis of the ultrasonic horn desirably and the first axis will substantially coincide, as shown in FIG. 1.

If desired, more than one means for applying ultrasonic energy may be located within the chamber defined by the die housing. Moreover, a single means may apply ultrasonic energy to the portion of the pressurized liquid which is in the vicinity of one or more exit orifices.

According to the present invention, the ultrasonic horn may be composed of a magnetostrictive material. The horn may be surrounded by a coil (which may be immersed in the liquid) capable of inducing a signal into the magnetostrictive material causing it to vibrate at ultrasonic frequencies. In such cases, the ultrasonic horn can simultaneously be the transducer and the means for applying ultrasonic energy to the multi-component liquid.

The application of ultrasonic energy to a plurality of exit orifices may be accomplished by a variety of methods. For example, with reference again to the use of an ultrasonic horn, the second end of the horn may have a cross-sectional area which is sufficiently large so as to apply ultrasonic energy to the portion of the pressurized liquid which is in the vicinity of all of the exit orifices in the die housing. In such case, the second end of the ultrasonic horn desirably will have a cross-sectional area approximately the same as or greater than a minimum area which encompasses all exit orifices in the die housing (i.e., a minimum area which is the same as or greater than the sum of the areas of the exit orifices in the die housing originating in the same chamber). Alternatively, the second end of the horn may have a plurality of protrusions, or tips, equal in number to the number of exit orifices. In this instance, the cross-sectional area of each protrusion or tip desirably will be approximately the same as or less than the cross-sectional area of the exit orifice with which the protrusion or tip is in close proximity.

The planar relationship between the second end of the ultrasonic horn and an array of exit orifices may also be shaped (e.g., parabolically, hemispherically, or provided with a shallow curvature) to provide or correct for certain spray patterns.

As already noted, the term "close proximity" is used herein to mean that the means for applying ultrasonic energy is sufficiently close to the exit orifice to apply the ultrasonic energy primarily to the pressurized liquid passing into the exit orifice. The actual distance of the means for applying ultrasonic energy from the exit orifice in any given situation will depend upon a number of factors, some of which are the flow rate and/or viscosity of the pressurized liquid fuel, the cross-sectional area of the end of the means for applying the ultrasonic energy relative to the cross-sectional area of the exit orifice, the frequency of the ultrasonic energy, the gain of the means for applying the ultrasonic energy (e.g., the magnitude of the longitudinal mechanical excitation of the means for applying ultrasonic energy), the temperature of the pressurized liquid, and the rate at which the liquid passes out of the exit orifice.

In general, the distance of the means for applying ultrasonic energy from the exit orifice in a given situation may be determined readily by one having ordinary skill in the art without undue experimentation. In practice, such distance will be in the range of from about 0.002 inch (about 0.05 mm) to about 1.3 inches (about 33 mm), although greater distances can be employed. Such distance determines the extent to which ultrasonic energy is applied to the pressurized liquid other than that which is about to enter the exit orifice; i.e., the greater the distance, the greater the amount of pressurized liquid which is subjected to ultrasonic energy. Consequently, shorter distances generally are desired in order to minimize degradation of the pressurized liquid and other adverse effects which may result from exposure of the liquid to the ultrasonic energy.

One advantage of the apparatus of the present invention is that it is self-cleaning. That is, the combination of supplied pressure and forces generated by ultrasonically exciting the means for supplying ultrasonic energy to the pressurized liquid (without applying ultrasonic energy directly to the orifice) can remove obstructions that appear to block the exit orifice (e.g., extrusion orifice). According to the invention, the exit orifice is adapted to be self-cleaning when the means for applying ultrasonic energy is excited with ultrasonic energy (without applying ultrasonic energy directly to the orifice) while the exit orifice receives pressurized liquid from the chamber and passes the liquid out of the die housing. Desirably, the means for applying ultrasonic energy is an immersed ultrasonic horn having a longitudinal mechanical excitation axis and in which the end of the horn located in the die housing nearest the orifice is in close proximity to the exit orifice but does not apply ultrasonic energy directly to the exit orifice.

An aspect of the present invention covers an apparatus for emulsifying a pressurized multi-component liquid. Generally speaking, the emulsifying apparatus has the configuration of the apparatus described above and the exit orifice is adapted to emulsify a pressurized multi-component liquid when the means for applying ultrasonic energy is excited with ultrasonic energy while the exit orifice receives pressurized multi-component liquid from the chamber. The pressurized multi-component liquid may then be passed out of the exit orifice in the die tip. The added step may enhance emulsification.

The present invention also includes a method of emulsifying a pressurized multi-component liquid. The method includes the steps of supplying a pressurized liquid to the die assembly described above; exciting means for applying ultrasonic energy (located within the die assembly) with ultrasonic energy while the exit orifice receives pressurized liquid from the chamber without applying ultrasonic energy directly to the exit orifice; and passing the liquid out of the exit orifice in the die tip so that the liquid is emulsified.

The present invention covers an apparatus for producing a spray of liquid. Generally speaking, the spray-producing apparatus has the configuration of the apparatus described above and the exit orifice is adapted to produce a spray of liquid when the means for applying ultrasonic energy is excited with ultrasonic energy while the exit orifice receives pressurized liquid from the chamber and passes the liquid out of the exit orifice in the die tip. The apparatus may be adapted to provide an atomized spray of liquid (i.e., a very fine spray or spray of very small droplets). The apparatus may be adapted to produce a uniform, cone-shaped spray of liquid. For example, the apparatus may be adapted to produce a cone-shaped spray of liquid having a relatively uniform density or distribution of droplets throughout the cone-shaped spray. Alternatively, the apparatus may be adapted to produce irregular patterns of spray and/or irregular densities or distributions of droplets throughout the cone-shaped spray.

The present invention also includes a method of producing a spray of liquid. The method includes the steps of supplying a pressurized liquid to the die assembly described above; exciting means for applying ultrasonic energy (located within the die assembly) with ultrasonic energy while the exit orifice receives pressurized liquid from the chamber without applying ultrasonic energy directly to the exit orifice; and passing the liquid out of the exit orifice in the die tip to produce a spray of liquid. According to the method of the invention, the conditions may be adjusted to produce an atomized spray of liquid, a uniform, cone-shaped spray, irregularly patterned sprays and/or sprays having irregular densities.

The apparatus and method may be used in fuel injectors for liquid-fueled combustors. Exemplary combustors include, but are not limited to, boilers, kilns, industrial and domestic furnaces, incinerators. Many of these combustors use heavy liquid fuels that may be advantageously handled by the apparatus and method of the present invention.

Internal combustion engines present other applications where the apparatus and method of the present invention may be used with fuel injectors. For example, the apparatus and method may be used in fuel injectors for discontinuous flow reciprocating piston gasoline and diesel engines. More particularly, a means for delivering ultrasonic vibrations is incorporated within a fuel injector. The vibrating element is placed so as to be in contact with the fuel as it enters an exit orifice. The vibrating element is aligned so the axis of its vibrations are parallel with the axis of the orifice. Immediately before the liquid fuel enters the exit orifice, the vibrating element in contact with the liquid fuel applies ultrasonic energy to the fuel. The vibrations appear to change the apparent viscosity and flow characteristics of the high viscosity liquid fuels. The vibrations also appear to improve the flow rate and/or improved atomization of the fuel stream as it enters the cylinder. Application of ultrasonic energy appears to improve (e.g., decrease) the size of liquid fuel droplets and narrow the droplet size distribution of the liquid fuel plume. Moreover, application of ultrasonic energy appears to increase the velocity of liquid fuel droplets exiting the orifice into a combustion chamber. The vibrations also cause breakdown and flushing out of clogging contaminants at the exit orifice. The vibrations can also cause emulsification of the liquid fuel with other components (e.g., liquid components) or additives that may be present in the fuel stream.

The apparatus and method may be used in fuel injectors for continuous flow engines such as Sterling heat engines and gas turbine engines. Such gas turbine engines may include torque reaction engines such as aircraft main and auxiliary engines, co-generation plants and other prime movers. Other gas turbine engines may include thrust reaction engines such as jet aircraft engines.

The apparatus and method of the present invention may be used to emulsify multi-component liquid fuels as well as liquid fuel additives and contaminants at the point where the liquid fuels are introduced into the combustor (e.g., internal combustion engine). For example, water entrained in certain fuels may be emulsified so that fuel/water mixture may be used in the combustor. Mixed fuels and/or fuel blends including components such as, for example, methanol, water, ethanol, diesel, liquid propane gas, bio-diesel or the like can also be emulsified. The present invention can have advantages in multi-fueled engines in that it may be used to compatibalize the flow rate characteristics (e.g., apparent viscosities) of the different fuels that may be used in the multi-fueled engine. Alternatively and/or additionally, it may be desirable to add water to one or more liquid fuels and emulsify the components immediately before combustion as a way of controlling combustion and/or reducing exhaust emissions. It may also be desirable to add a gas (e.g., air, $N_2O$, etc.) to one or more liquid fuels and ultrasonically blend or emulsify the components immediately before combustion as a way of controlling combustion and/or reducing exhaust emissions.

The present invention is further described by the examples which follow. Such examples, however, are not to be construed as limiting in any way either the spirit or the scope of the present invention.

EXAMPLES

Ultrasonic Horn Apparatus

The following is a description of an exemplary ultrasonic horn apparatus of the present invention generally as shown in FIG. 1.

With reference to FIG. 1, the die housing 102 of the apparatus was a cylinder having an outer diameter of 1.375 inches (about 34.9 mm), an inner diameter of 0.875 inch (about 22.2 mm), and a length of 3.086 inches (about 78.4 mm). The outer 0.312-inch (about 7.9-mm) portion of the second end 108 of the die housing was threaded with 16-pitch threads. The inside of the second end had a beveled edge 126, or chamfer, extending from the face 128 of the second end toward the first end 106 a distance of 0.125 inch (about 3.2 mm). The chamfer reduced the inner diameter of the die housing at the face of the second end to 0.75 inch (about 19.0 mm). An inlet 110 (also called an inlet orifice) was drilled in the die housing, the center of which was 0.688 inch (about 17.5 mm) from the first end, and tapped. The inner wall of the die housing consisted of a cylindrical portion 130 and a conical frustrum portion 132. The cylindrical portion extended from the chamfer at the second end toward the first end to within 0.992 inch (about 25.2 mm) from the face of the first end. The conical frustrum portion extended from the cylindrical portion a distance of 0.625 inch (about 15.9 mm), terminating at a threaded opening 134 in the first end. The diameter of the threaded opening was 0.375 inch (about 9.5 mm); such opening was 0.367 inch (about 9.3 mm) in length.

A die tip 136 was located in the threaded opening of the first end. The die tip consisted of a threaded cylinder 138 having a circular shoulder portion 140. The shoulder portion was 0.125 inch (about 3.2 mm) thick and had two parallel faces (not shown) 0.5 inch (about 12.7 mm) apart. An exit orifice 112 (also called an extrusion orifice) was drilled in the shoulder portion and extended toward the threaded portion a distance of 0.087 inch (about 2.2 mm). The diameter of the extrusion orifice was 0.0145 inch (about 0.37 mm). The extrusion orifice terminated within the die tip at a vestibular portion 142 having a diameter of 0.125 inch (about 3.2 mm) and a conical frustrum portion 144 which joined the vestibular portion with the extrusion orifice. The wall of the conical frustrum portion was at an angle of 30° from the vertical. The vestibular portion extended from the extrusion orifice to the end of the threaded portion of the die tip, thereby connecting the chamber defined by the die housing with the extrusion orifice.

The means for applying ultrasonic energy was a cylindrical ultrasonic horn 116. The horn was machined to resonate at a frequency of 20 kHz. The horn had a length of 5.198 inches (about 132.0 mm), which was equal to one-half of the resonating wavelength, and a diameter of 0.75 inch (about 19.0 mm). The face 146 of the first end 118 of the horn was drilled and tapped for a ⅜-inch (about 9.5-mm) stud (not shown). The horn was machined with a collar 148 at the nodal point 122. The collar was 0.094-inch (about 2.4-mm) wide and extended outwardly from the cylindrical surface of the horn 0.062 inch (about 1.6 mm). Thus, the diameter of the horn at the collar was 0.875 inch (about 22.2 mm). The second end 120 of the horn terminated in a small cylindrical tip 150 0.125 inch (about 3.2 mm) long and 0.125 inch (about 3.2 mm) in diameter. Such tip was separated from the cylindrical body of the horn by a parabolic frustrum portion 152 approximately 0.5 inch (about 13 mm) in length. That is, the curve of this frustrum portion as seen in cross-section was parabolic in shape. The face of the small cylindrical tip was normal to the cylindrical wall of the horn and was located about 0.4 inch (about 10 mm) from the extrusion orifice. Thus, the face of the tip of the horn, i.e., the second end of the horn, was located immediately above the vestibular opening in the threaded end of the die tip.

The first end 108 of the die housing was sealed by a threaded cap 154 which also served to hold the ultrasonic horn in place. The threads extended upwardly toward the top of the cap a distance of 0.312 inch (about 7.9 mm). The outside diameter of the cap was 2.00 inches (about 50.8 mm) and the length or thickness of the cap was 0.531 inch (about 13.5 mm). The opening in the cap was sized to accommodate the horn; that is, the opening had a diameter of 0.75 inch (about 19.0 mm). The edge of the opening in the cap was a chamfer 156 which was the mirror image of the chamfer at the second end of the die housing. The thickness of the cap at the chamfer was 0.125 inch (about 3.2 mm), which left a space between the end of the threads and the bottom of the chamfer of 0.094 inch (about 2.4 mm), which space was the same as the length of the collar on the horn. The diameter of such space was 1.104 inch (about 28.0 mm). The top 158 of the cap had drilled in it four ¼-inch diameter×¼-inch deep holes (not shown) at 90° intervals to accommodate a pin spanner. Thus, the collar of the horn was compressed between the two chamfers upon tightening the cap, thereby sealing the chamber defined by the die housing.

Figure 7:
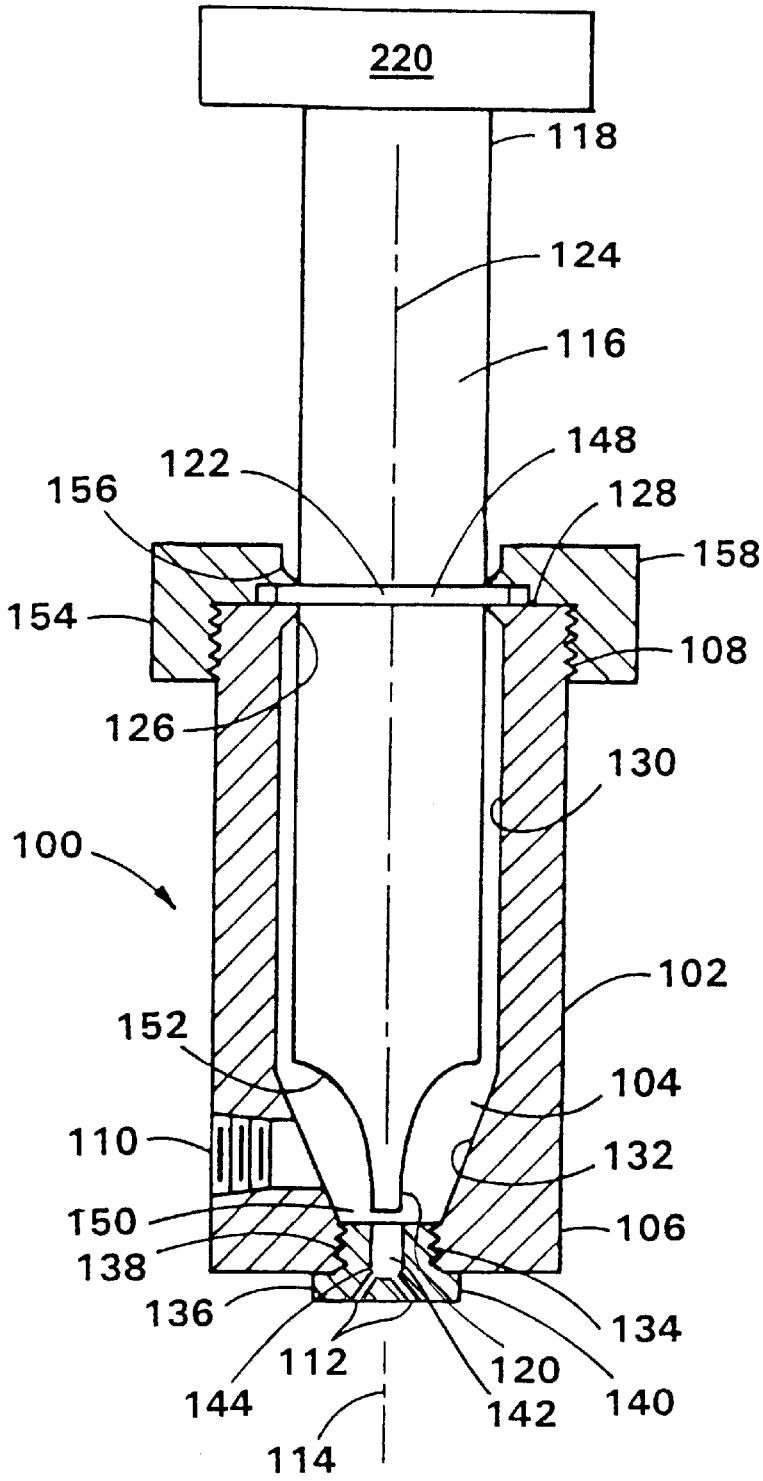
FIG. 7 is a diagrammatic cross-sectional representation of an embodiment similar to FIG. 1 further depicting a plurality of exit orifices and the means for vibrating an ultrasonic horn.

A Branson elongated aluminum waveguide having an input:output mechanical excitation ratio of 1:1.5 was coupled to the ultrasonic horn by means of a ⅜-inch (about 9.5-mm) stud. To the elongated waveguide was coupled a vibrator, in this case a piezoelectric transducer 220 as shown in FIG. 7, a Branson Model 502 Converter, which was powered by a Branson Model 1120 Power Supply operating at 20 kHz (Branson Sonic Power Company, Danbury, Conn.). Power consumption was monitored with a Branson Model A410A Wattmeter.

Example 1

This example illustrates the present invention as it relates to producing a spray of a hydrocarbon oil that may be used as fuel. The procedure was conducted utilizing the same ultrasonic device (immersed horn) as Example 1 set up in the same configuration with the following exceptions:

Two different orifices were used. One had a diameter of 0.004 inch and a length of 0.004 inch (L/D ratio of 1) and the other had a diameter of 0.010 and a length of 0.006 inch (L/D ratio of 0.006/0.010 or 0.6).

The oil used was a vacuum pump oil having the designation HE-200, Catalog # 98-198-006 available from Legbold-Heraeus Vacuum Products, Inc. of Export, Pa. The trade literature reported that the oil had a kinematic viscosity of 58.1 centipoise (cP) at 104° Fahrenheit and a kinematic viscosity of 9.14 cP at 212° Fahrenheit Flow rate trials were conducted on the immersed horn with the various tips without ultrasonic power, at 80 watts of power, and at 90 watts of power. Results of the trials are shown in Table 5. In Table 5, the "Pressure" column is the pressure in psig, the "TIP" column refers to the diameter and the length of the capillary tip (i.e., the exit orifice) in inches, the "Power" column refers to power consumption in watts at a given power setting, and the "Rate" column refers to the flow rate measured for each trial, expressed in g/min.

In every trial when the ultrasonic device was powered, the oil stream instantly atomized into a uniform, cone-shaped spray of fine droplets.

TABLE 1

Vacuum Pump Oil HE-200

| Pressure | TIP Diameter × Length (inches) | | Power | Rate |
|---|---|---|---|---|
| 150 | 0.004 | 0.004 | 0 | 11.8 |
| 150 | | | 80 | 12.6 |
| 150 | | | 90 | 16.08 |
| 250 | 0.004 | 0.004 | 0 | 13.32 |
| 250 | | | 80 | 14.52 |
| 250 | | | 90 | 17.16 |
| 150 | 0.010 | 0.006 | 0 | 20.76 |
| 150 | | | 80 | 22.08 |
| 150 | | | 90 | 25.80 |
| 250 | 0.10 | 0.006 | 0 | 24.00 |
| 250 | | | 80 | 28.24 |
| 250 | | | 90 | 31.28 |

Example 2

This example illustrates the present invention as it relates to the emulsification of disparate liquids such as oil and water. In this example, an emulsion was formed from water and a hydrocarbon-based oil. The oil chosen for the trials was a petroleum-based viscosity standard oil obtained from the Cannon Instrument Company of State College, Pa., standard number N1000, lot # 92102.

The oil was pressurized and supplied by the pump, drive motor, and motor controller as described above. In this case the output from the pump was connected to one leg of a ¼" tee fitting. The opposite parallel leg of the tee fitting was connected to the entrance of a six element ½" diameter ISG Motionless Mixer obtained from Ross Engineering, Inc. of Savannah, Ga. The outlet of the mixer was connected to the inlet of the immersed horn ultrasonic device (See FIG. 1). Water was metered into the oil stream a by piston metering pump. The pump consisted of a 9/16" diameter by 5" stroke hydraulic cylinder. The piston rod of the cylinder was advanced by a jacking screw driven by a variable speed motor through reduction gears. The speed of the motor was controlled utilizing a motor controller. The water was routed from the cylinder to the third leg of the tee by a flexible hose. The outlet end of the flexible hose was fitted with a length of stainless steel hypodermic tubing of about 0.030" inside diameter which, with the flexible hose installed to the tee, terminated in the approximate center of the oil flow stream (upstream of the ultrasonic device).

The immersed horn device was fitted with the 0.0145" diameter tip. The oil was pressurized to about 250 psig., creating a flow rate of about 35 g/min. The metering pump was set at about 3 rpm resulting in a water flow rate of 0.17 cc/min. Samples of the extrudate (i.e., the liquid output from the ultrasonic device) were taken with no ultrasonic power, and at about 100 watts ultrasonic power. The samples were examined with an optical microscope. The sample that passed through the ultrasonic device while it was unpowered contained widely dispersed water droplets ranging from about 50–300 micrometers in diameter. The sample that passed through the ultrasonic device while it received 100 watts of power (i.e., the ultrasonically treated sample) was an emulsion that contained a dense population of water droplets ranging from about 5 to less than 1 micrometer in diameter.

Example 3

This example illustrates the present invention as it relates to the size and characteristics of droplets in a plume of No. 2 diesel fuel injected into the atmosphere utilizing the ultrasonic apparatus described above. Diesel fuel was fed to the ultrasonic apparatus utilizing the pump, drive motor, and motor controller as described above. Tests were conducted at pressures of 250 psig and 500 psig, with and without applied ultrasonic energy.

The diesel fuel was injected into ambient air at 1 atmosphere of pressure. All test measurements of the diesel fuel plume were taken at a point 60 mm below the bottom surface of the nozzle, directly below the nozzle. The nozzle was a plain orifice in the form of a capillary tip having an diameter of 0.006 inch and a length of 0.024 inch. The frequency of the ultrasonic energy was 20 kHz and the transducer power (in watts) were read from the power controller and recorded for each test.

Droplet size was measured utilizing a Malvern Droplet and Particle Sizer, Model Series 2600C, available from Malvern Instruments, Ltd., Malvern, Worcestershire, England. A typical spray includes a wide variety of droplet sizes. Difficulties in specifying droplet size distributions in sprays have led to use of various expressions of diameter. The particle sizer was set to measure the drop diameter and report it as the Sauter mean diameter (SMD, also referred to as $D_{32}$) which represents the ratio of the volume to the surface area of the spray (i.e., the diameter of a droplet whose surface to volume ratio is equal to that of the entire spray).

The droplet velocity is reported as a mean velocity in units of meters per second and was measured utilizing an Aerometrics Phase Doppler Particle Analyzer available from Aerometrics Inc., Mountain View, California. The Phase Doppler Particle analyzer was composed of a Transmitter—Model No. XMT-1100-4S; a Receiver—Model No. RCV-2100-1; and a Processer—Model No. PDP-3200. The results are reported in Table 2.

TABLE 2

| Run | Pressure | Transducer Power | SMD (um) | Velocity (m/s) |
|---|---|---|---|---|
| 1 | 250 PSIG | 0 watts | 87.0 | 33.9 |
| 2 | 250 PSIG | 0 watts | 86.9 | 33.6 |
| 3 | 250 PSIG | 87.5 watts | 41.1 | 39.2 |
| 4 | 250 PSIG | 87.5 watts | 40.8 | 38.2 |
| 5 | 500 PSIG | 0 watts | 43.4 | 40.4 |
| 6 | 500 PSIG | 0 watts | 46.8 | 41.2 |
| 7 | 500 PSIG | 102 watts | 41.0 | 56.3 |
| 8 | 500 PSIG | 102 watts | 40.9 | 56.5 |

As may be seen from the results reported in Table 2, the velocity of liquid fuel droplets may be at least about 25 percent greater than the velocity of identical pressurized liquid fuel droplets out of an identical die housing through an identical exit orifice in the absence of excitation by ultrasonic energy. For example, the velocity of pressurized liquid fuel droplets can be at least about 35 percent greater than the velocity of droplets of an identical pressurized liquid fuel out of an identical die housing through an identical exit orifice in the absence of excitation by ultrasonic energy. Droplet velocity is generally thought to be associated with the ability of a spray plume to penetrate and disperse in a combustion chamber, especially if the atmosphere in the chamber is pressurized.

In addition to affecting droplet velocity, application of ultrasonic energy can help reduce individual droplet size and size distribution. Generally speaking, it is thought that small sized fuel droplets of a relatively narrow size distribution will tend to burn more uniformly and cleanly than very large droplets. As can be seen from Table 2, the Sauter mean diameter of pressurized liquid fuel droplets can be at least about 5 percent smaller than the Sauter mean diameter of droplets of an identical pressurized liquid fuel out of an identical die housing through an identical exit orifice in the absence of excitation by ultrasonic energy. For example, the Sauter mean diameter of pressurized liquid fuel droplets can be at least about 50 percent smaller than the Sauter mean diameter of droplets of an identical pressurized liquid fuel out of an identical die housing through an identical exit orifice in the absence of excitation by ultrasonic energy.

Example 4

Figure 2:
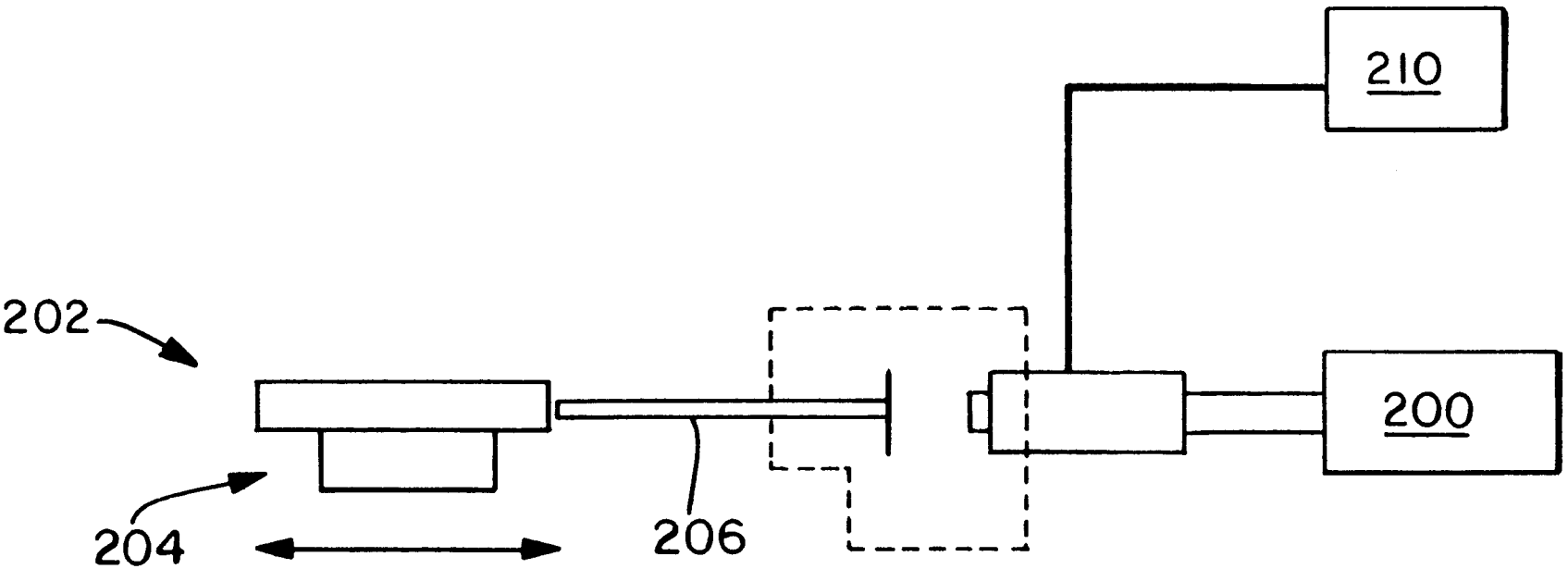
FIG. 2 is an illustration of a device used to measure the force or impulse of droplets in a water plume injected into the atmosphere utilizing an exemplary ultrasonic apparatus.

This example illustrates the present invention as it relates to the force or impulse of the droplets in a water plume injected into the atmosphere utilizing the ultrasonic apparatus described above. Referring now to FIG. 2 of the drawings, the 20 kHz ultrasonic apparatus 200 described above was mounted in a horizontal position. The capillary tip used in these trials had a constant diameter of 0.015" for a length of 0.010", then the walls diverged at 7° for an additional 0.015" of length to the exit making a total length of 0.025". A force gage 202, model ML 4801-4 made by the Mansfield and Green division of the Ametek Company of Largo, Florida, was positioned with its input axis coincidental with the discharge axis of the capillary tip. The force gage was mounted on a standard micrometer slide mechanism 204 oriented to move the gage along its input axis. The input shaft 206 of the gage was fitted with a 1" diameter plastic target disk 208. In operation, the target disk was positionable from 0.375" to 1.55" from the outlet of the capillary tip. Water was pressurized by a water pump 210 (Chore Master pressure washer pump made by the Mi-T-M Corporation of Peosta, Iowa). Water flow rate was measured using a tapered tube flowmeter serial # D-4646 made by the Gilmont Instruments, Inc.

For a given set of conditions, the trials proceeded as follows. The target disk was positioned from the capillary tip in increments of 0.10". Next, the ultrasonic power supply, if used, was preset to the desired power level, Next the water pump was started, and the desired pressure established. Next ultrasonic power, if used, was turned on. Readings were then taken of power in watts, flow rate in raw data, and impact force in grams. The raw data is reported in Table 3.

Figure 3:
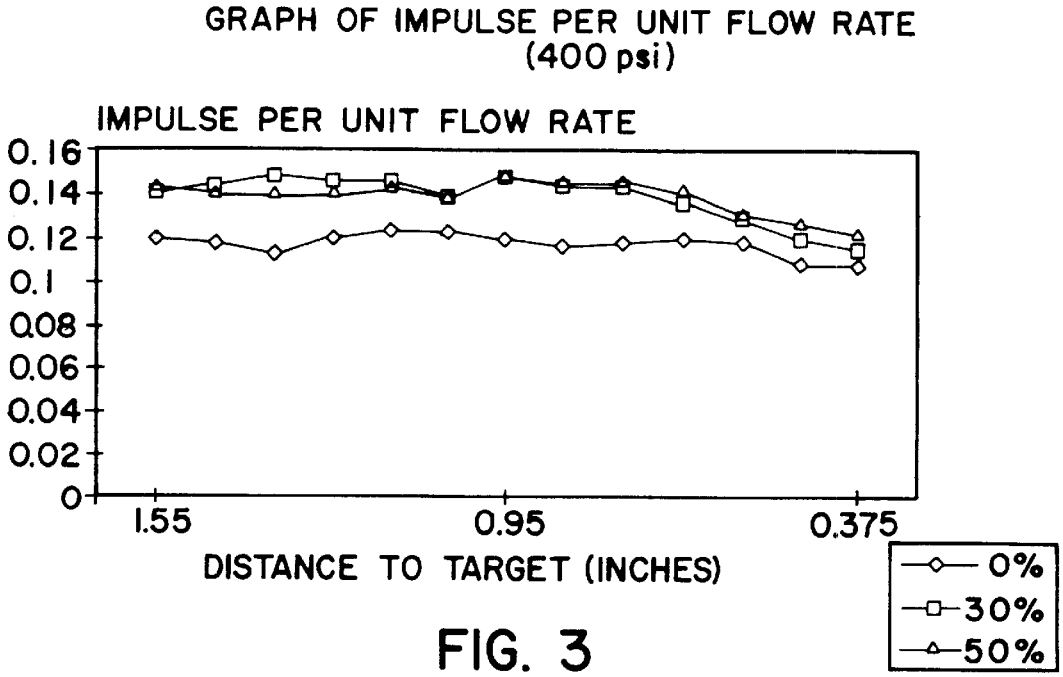
FIGS. 3–6 are graphical representations of impact force per mass flow of liquid versus distance.
Figure 4:
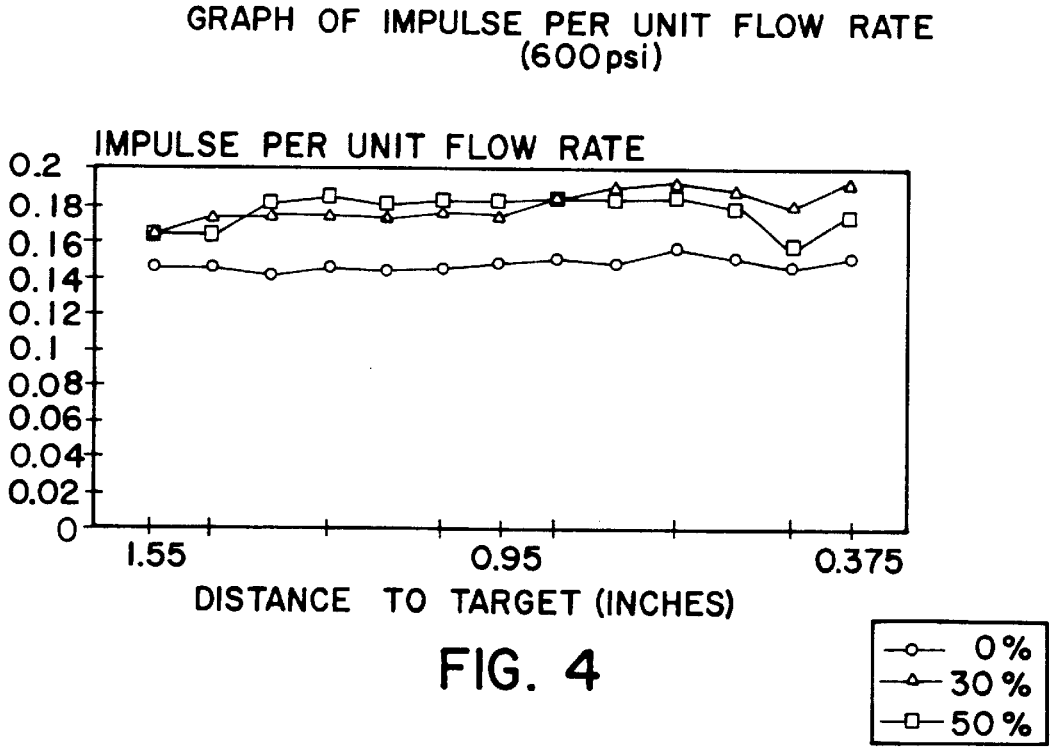
Figure 5:
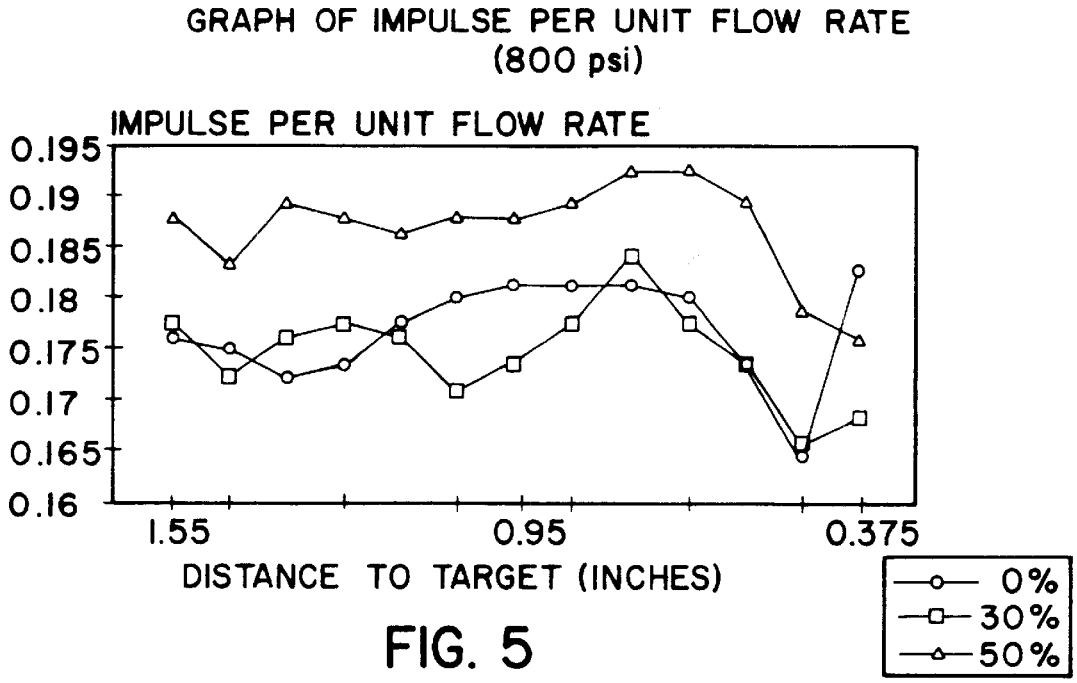
Figure 6:
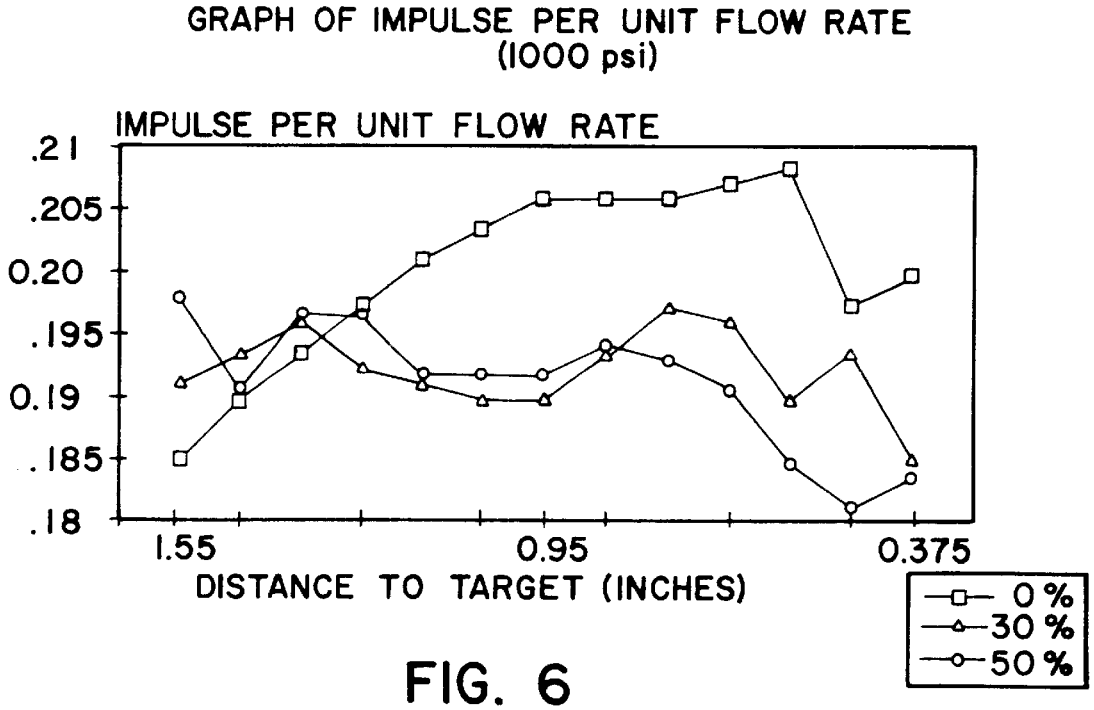

The data was normalized to represent force in grams per unit of mass flow. The normalized data is reported in Table 4. The normalized data indicate that the addition of ultrasonic energy causes an increase in impact force per mass flow of water. This appears to be directly translatable to an increase in velocity of individual droplets in a spray plume. This normalized data is shown graphically in FIGS. 3 through 6. In particular, FIG. 3 is a plot of impact force per mass flow of water versus distance to target at 400 psig. FIG. 4 is a plot of impact force per mass flow of water versus distance to target at 600 psig. FIG. 5 is a plot of impact force per mass flow of water versus distance to target at 800 psig. FIG. 6 is a plot of impact force per mass flow of water versus distance to target at 1000 psig.

As the pressure in the trials approached 1000 psi. the power delivered by the power supply dropped off drastically, an indication that the ultrasonic assembly had shifted resonance to a point beyond the ability of the power supply to compensate. The impact effect for these trials (i.e., at 1000 psig) was diminished.

TABLE 3

RAW DATA - PLUME IMPACT STUDY

| Power | Press. | Flow | Flow | Power | Distance to Target | | | | | | | | | | | | |
|---|---|---|---|---|---|---|---|---|---|---|---|---|---|---|---|---|---|
| Set | psig | Raw | L/min | Watt | 1.55" | 1.45" | 1.35" | 1.25" | .15" | 1.05" | 0.95" | 0.85" | 0.75" | 0.65" | 0.55" | 0.45" | 0.375" |
| 0% | 1000 | 78 | 0.811 | 0 | 150 | 154 | 157 | 160 | 163 | 165 | 167 | 167 | 167 | 168 | 169 | 160 | 162 |
| 30% | 1000 | 78 | 0.811 | 125 | 155 | 157 | 159 | 156 | 155 | 154 | 154 | 157 | 160 | 159 | 154 | 157 | 150 |
| 50% | 1000 | 80 | 0.834 | 250 | 165 | 159 | 164 | 164 | 160 | 160 | 160 | 162 | 161 | 159 | 154 | 151 | 153 |
| 0% | 800 | 75 | 0.777 | 0 | 137 | 136 | 134 | 135 | 138 | 140 | 141 | 141 | 141 | 140 | 135 | 128 | 142 |
| 30% | 800 | 73 | 0.754 | 120 | 134 | 130 | 133 | 134 | 133 | 129 | 131 | 134 | 139 | 134 | 131 | 125 | 127 |
| 50% | 800 | 65 | 0.659 | 375 | 124 | 121 | 125 | 124 | 123 | 124 | 124 | 125 | 127 | 127 | 125 | 118 | 116 |
| 0% | 600 | 67 | 0.683 | 0 | 99 | 99 | 96 | 99 | 98 | 99 | 101 | 103 | 101 | 107 | 103 | 99 | 103 |
| 30% | 600 | 53 | 0.515 | 225 | 84 | 89 | 90 | 90 | 89 | 91 | 90 | 95 | 97 | 99 | 97 | 93 | 99 |
| 50% | 600 | 53 | 0.515 | 400 | 84 | & | 93 | 95 | 93 | 94 | 94 | 95 | 95 | 95 | 92 | 81 | 89 |
| 0% | 400 | 58 | 0.575 | 84 | 69 | 68 | 65 | 69 | 71 | 71 | 69 | 67 | 68 | 69 | 68 | 62 | 62 |
| 30% | 400 | 45 | 0.418 | 200 | 59 | 60 | 62 | 61 | 61 | 58 | 62 | 60 | 60 | 57 | 54 | 50 | 48 |
| 50% | 400 | 45 | 0.418 | 325 | 60 | 59 | 59 | 59 | 60 | 58 | 62 | 61 | 61 | 59 | 55 | 53 | 51 |

TABLE 4

THRUST/ML/MIN

| | Distance to Target (inches) | | | | | | | | | | | | |
|---|---|---|---|---|---|---|---|---|---|---|---|---|---|
| Power | 1.55 | 1.45 | 1.35 | 1.25 | 1.15 | 1.05 | 0.95 | 0.85 | 0.75 | 0.65 | 0.55 | 0.45 | 0.38 |
| Pressure 1000 psig | | | | | | | | | | | | | |
| 0% | 0.185 | 0.19 | 0.194 | 0.197 | 0.201 | 0.203 | 0.206 | 0.21 | 0.21 | 0.207 | 0.21 | 0.197 | 0.2 |
| 30% | 0.191 | 0.194 | 0.196 | 0.192 | 0.191 | 0.19 | 0.19 | 0.19 | 0.2 | 0.196 | 0.19 | 0.194 | 0.18 |
| 50% | 0.198 | 0.191 | 0.197 | 0.197 | 0.192 | 0.192 | 0.192 | 0.19 | 0.19 | 0.191 | 0.18 | 0.181 | 0.18 |
| Pressure 800 psig | | | | | | | | | | | | | |
| 0% | 0.176 | 0.175 | 0.172 | 0.174 | 0.178 | 0.18 | 0.181 | 0.18 | 0.18 | 0.18 | 0.17 | 0.165 | 0.18 |
| 30% | 0.178 | 0.172 | 0.176 | 0.178 | 0.176 | 0.171 | 0.174 | 0.18 | 0.18 | 0.178 | 0.17 | 0.166 | 0.17 |
| 50% | 0.188 | 0.184 | 0.19 | 0.188 | 0.187 | 0.188 | 0.188 | 0.19 | 0.19 | 0.193 | 0.19 | 0.179 | 0.18 |
| Pressure 600 psig | | | | | | | | | | | | | |
| 0% | 0.145 | 0.145 | 0.141 | 0.145 | 0.143 | 0.145 | 0.148 | 0.15 | 0.15 | 0.157 | 0.15 | 0.145 | 0.15 |
| 30% | 0.163 | 0.173 | 0.175 | 0.175 | 0.173 | 0.177 | 0.175 | 0.18 | 0.19 | 0.192 | 0.19 | 0.181 | 0.19 |
| 50% | 0.163 | 0.163 | 0.181 | 0.184 | 0.181 | 0.183 | 0.183 | 0.18 | 0.18 | 0.184 | 0.18 | 0.157 | 0.17 |
| Pressure 400 psig | | | | | | | | | | | | | |
| 0% | 0.12 | 0.118 | 0.113 | 0.12 | 0.123 | 0.123 | 0.12 | 0.12 | 0.12 | 0.12 | 0.12 | 0.108 | 0.11 |
| 30% | 0.141 | 0.144 | 0.148 | 0.146 | 0.146 | 0.139 | 0.148 | 0.14 | 0.14 | 0.136 | 0.13 | 0.12 | 0.11 |
| 50% | 0.144 | 0.141 | 0.141 | 0.141 | 0.144 | 0.139 | 0.148 | 0.15 | 0.15 | 0.141 | 0.13 | 0.127 | 0.12 |

Example 5

This example illustrates the present invention as it relates to the size characteristics of droplets in a plume of No. 2 diesel fuel injected into the atmosphere utilizing the ultrasonic apparatus described above. Diesel fuel was fed to the ultrasonic apparatus utilizing the pump, drive motor, and motor controller as described above. Tests were conducted at pressures from 100 psig to 1000 psig (in increments of 100 psig) with and without applied ultrasonic energy.

The diesel fuel was injected into ambient air at 1 atmosphere of pressure. All test measurements of the diesel fuel plume were taken at a point 50 mm below the bottom surface of the nozzle, directly below the nozzle. The nozzle was a plain orifice in the form of a capillary tip having an diameter of 0.006 inch and a length of 0.024 inch. The tip of the ultrasonic horn was located 0.075 inch from the opening in the capillary tip. The frequency of the ultrasonic energy, volts, current were read from the power meter and recorded for each test. The watts used were calculated from available data.

Droplet size was measured utilizing a Malvern Droplet and Particle Sizer, Model Series 2600C, available from Malvern Instruments, Ltd., Malvern, Worcestershire, England. A typical spray includes a wide variety of droplet sizes. Difficulties in specifying droplet size distributions in sprays have led to the use of various expressions of diameter. The particle sizer was set to measure the drop diameter such that 50% of total liquid volume is in drops of smaller diameter ($D_{0.5}$); the drop diameter such that 90% of total liquid volume is in drops of smaller diameter ($D_{0.9}$); and the Sauter mean diameter (SMD, also referred to as $D_{32}$) which represents the ratio of the volume to the surface area of the spray (i.e., the diameter of a droplet whose surface to volume ratio is equal to that of the entire spray). The results are reported in Table 5.

TABLE 5

| | | | | | Droplet Size | | |
|---|---|---|---|---|---|---|---|
| Pressure (psig) | Frequency (kHz) | Volts (volts) | Current (amps) | Watts (calc.) | SMD (μm) | 50% Size (μm) | 90% Size (μm) |
| 100 | 19.88 | 189.9 | 1.065 | 202.2 | 37.61 | 50.23 | 83.79 |
| 100 | 19.88 | 189.9 | 1.065 | 202.2 | 38.48 | 51.41 | 86.38 |
| 100 | 0 | 0 | 0 | 0 | 295.19 | 355.96 | 517.05 |
| 100 | 0 | 0 | 0 | 0 | 301.79 | 370.29 | 520.98 |
| 200 | 19.84 | 223.1 | 1.058 | 236.0 | 25.52 | 35.32 | 60.99 |
| 200 | 19.84 | 223.1 | 1.058 | 236.0 | 26.57 | 36.32 | 61.94 |
| 200 | 0 | 0 | 0 | 0 | 167.38 | 275.85 | 492.53 |
| 200 | 0 | 0 | 0 | 0 | 188.81 | 261.95 | 483.32 |
| 300 | 19.83 | 235.9 | 1.124 | 265.1 | 27.57 | 39.23 | 69.68 |
| 300 | 19.83 | 235.9 | 1.124 | 265.1 | 27.93 | 39.73 | 70.56 |
| 300 | 0 | 0 | 0 | 0 | 135.87 | 244.13 | 479.05 |
| 300 | 0 | 0 | 0 | 0 | 147.80 | 247.30 | 480.97 |
| 400 | 19.83 | 257.4 | 1.203 | 309.7 | 23.74 | 34.11 | 61.20 |
| 400 | 19.83 | 257.4 | 1.203 | 309.7 | 23.74 | 34.11 | 61.20 |
| 400 | 0 | 0 | 0 | 0 | 114.84 | 234.58 | 476.21 |
| 400 | 0 | 0 | 0 | 0 | 110.83 | 232.97 | 475.85 |
| 500 | 19.82 | 280.9 | 1.294 | 363.5 | 23.54 | 33.21 | 58.48 |
| 500 | 19.82 | 280.9 | 1.294 | 363.5 | 23.54 | 33.21 | 58.48 |
| 500 | 0 | 0 | 0 | 0 | 67.99 | 137.98 | 327.17 |
| 500 | 0 | 0 | 0 | 0 | 67.99 | 137.98 | 327.17 |
| 600 | 19.83 | 265.3 | 1.235 | 327.6 | 23.89 | 35.86 | 67.22 |
| 600 | 19.83 | 265.3 | 1.235 | 327.6 | 22.90 | 34.85 | 66.30 |
| 600 | 0 | 0 | 0 | 0 | 61.07 | 132.14 | 327.75 |
| 600 | 0 | 0 | 0 | 0 | 59.53 | 126.07 | 306.33 |
| 700 | 19.82 | 298.9 | 1.364 | 407.7 | 20.12 | 31.54 | 62.10 |
| 700 | 19.82 | 298.9 | 1.364 | 407.7 | 20.67 | 31.97 | 61.98 |
| 700 | 0 | 0 | 0 | 0 | 51.36 | 113.51 | 284.40 |
| 700 | 0 | 0 | 0 | 0 | 51.36 | 113.51 | 284.40 |
| 800 | 19.83 | 286.7 | 1.322 | 379.0 | 19.75 | 31.92 | 64.99 |
| 800 | 19.83 | 286.7 | 1.322 | 379.0 | 19.75 | 31.92 | 64.99 |
| 800 | 0 | 0 | 0 | 0 | 41.57 | 93.38 | 234.49 |
| 800 | 0 | 0 | 0 | 0 | 41.57 | 93.38 | 234.49 |
| 900 | 19.82 | 299.6 | 1.361 | 407.8 | 17.63 | 29.35 | 62.29 |
| 900 | 19.82 | 299.6 | 1.361 | 407.8 | 17.63 | 29.35 | 62.29 |
| 900 | 0 | 0 | 0 | 0 | 27.08 | 53.62 | 130.24 |
| 900 | 0 | 0 | 0 | 0 | 26.89 | 56.73 | 146.30 |
| 1000 | 19.82 | 312.0 | 1.390 | 433.7 | 15.51 | 29.57 | 75.74 |
| 1000 | 19.82 | 312.0 | 1.390 | 433.7 | 15.51 | 29.57 | 75.74 |
| 1000 | 0 | 0 | 0 | 0 | 24.47 | 54.45 | 150.39 |
| 1000 | 0 | 0 | 0 | 0 | 25.03 | 54.71 | 147.76 |

As can be seen from Table 5, the apparatus and method of the present invention can produce significant reduction in the Sauter mean diameter, $D_{0.9}$ and $D_{0.5}$. This effect appears to diminish at higher pressures, primarily due to shifting resonance of the ultrasonic assembly beyond the ability of the power supply to compensate.

This application is one of a group of commonly assigned patent applications which are being filed on the same date. The group includes application Ser. No. 08/576,543 entitled "An Apparatus And Method For Emulsifying A Pressurized Multi-Component Liquid", Docket No. 12535, in the name of L. K. Jameson et al.; application Ser. No. 08/576,536, now granted U.S. Pat. No. 6,053,424, entitled "An Apparatus And Method For Ultrasonically Producing A Spray Of Liquid", Docket No. 12536, in the name of L. H. Gipson et al.; application Ser. No. 08/576,522 entitled "Ultrasonic Fuel Injection Method And Apparatus", Docket No. 12537, in the name of L. H. Gipson et al.; application Ser. No. 08/576,174, now granted U.S. Pat. No. 5,803,106, entitled "An Ultrasonic Apparatus And Method For Increasing The Flow Rate Of A Liquid Through An Orifice", Docket No. 12538, in the name of B. Cohen et al.; and application Ser. No. 08/576,175, now granted U.S. Pat. No. 5,868,153, entitled "Ultrasonic Flow Control Apparatus And Method", Docket No. 12539, in the name of B. Cohen et al. The subject matter of these applications is hereby incorporated by reference.

What is claimed is:

1. An ultrasonic fuel injector apparatus for injection of liquid fuel into an internal combustion engine, the apparatus comprising:

a die housing defining:

a chamber adapted to receive a pressurized liquid fuel;

an inlet adapted to supply the chamber with the pressurized liquid fuel; and a die tip, the walls of the die tip defining at least one vestibular portion terminating in at least one exit orifice, the vestibular portion being adapted to receive the pressurized liquid fuel from the chamber and pass the liquid fuel to the exit orifice and out of the die housing: and a means for applying ultrasonic energy to a portion of the pressurized liquid fuel without vibrating the die tip, the means for applying ultrasonic energy is affixed at a nodal point to the die housing and terminates in a distal end wherein the means for applying ultrasonic energy is located in close proximity to the vestibular portion and the distal end comprises a cross-sectional area equal to the opening of the vestibular portion.

2. The apparatus of claim 1, wherein the means for applying ultrasonic energy is an immersed ultrasonic horn.

3. The apparatus of claim 1, wherein the means for applying ultrasonic energy is an immersed magnetostrictive ultrasonic horn.

4. The apparatus of claim 1, wherein the exit orifice is a plurality of exit orifices.

5. The apparatus of claim 1, wherein the exit orifice is a single exit orifice.

6. The apparatus of claim 1, wherein the exit orifice has a diameter of from about 0.0001 to about 0.1 inch.

7. The apparatus of claim 6, wherein the exit orifice has a diameter of from about 0.001 to about 0.01 inch.

8. The apparatus of claim 1, wherein the exit orifice is an exit capillary.

9. The apparatus of claim 8, wherein the exit capillary has a length to diameter ratio of from about 4:1 to about 10:1.

10. The apparatus of claim 1, wherein the ultrasonic energy has a frequency of from about 15 kHz to about 500 kHz.

11. The apparatus of claim 1, adapted to inject the pressurized liquid fuel into the internal combustion engine in the form of an atomized plume.

12. The apparatus of claim 1, wherein the die tip is removable from the die housing.

13. An ultrasonic fuel injector apparatus for injection of liquid fuel into an internal combustion engine, the apparatus comprising:

a die housing having a first end and a second end and defining:

a chamber adapted to receive a pressurized liquid fuel;

an inlet adapted to supply the chamber with the pressurized liquid fuel; and a die tip, the die tip being located in the first end of the die housing, the walls of the die tip further define at least one vestibular portion and at least one exit orifice, the at least one vestibular portion terminating in the at least one exit orifice, the vestibular portion adapted to receive the pressurized liquid fuel from the chamber and pass the liquid fuel to the exit orifice and out of the die housing along a first axis; and an ultrasonic horn having a first end and a second end and adapted, upon excitation by ultrasonic energy, to have a node and a longitudinal mechanical excitation axis, the horn being affixed to the die housing at the node in a manner such that the first end of the horn is located outside the die housing and the second end of the horn is located inside the die housing, the second end comprising a cross-sectional area equal to the opening of the vestibular portion and further terminating within the chamber. in close proximity to the vestibular portion.

14. The apparatus of claim 13, wherein the ultrasonic horn is an immersed magnetostrictive ultrasonic horn.

15. The apparatus of claim 13, herein the ultrasonic horn has coupled to the first end thereof a vibrator means as a source of longitudinal mechanical excitation.

16. The apparatus of claim 15, wherein the vibrator means is a piezoelectric transducer.

17. The apparatus of claim 15, wherein the vibrator means is a magnetostrictive transducer.

18. The apparatus of claim 13, wherein the ultrasonic energy has a frequency of from about 15 kHz to about 500 kHz.

19. The apparatus of claim 13, wherein the longitudinal mechanical excitation axis is substantially parallel with the first axis.

20. A method of injecting a pressurized liquid fuel through an orifice, the method comprising:

supplying a pressurized liquid fuel to a die assembly, the die assembly being composed of:

a die housing comprising:

a chamber adapted to receive the pressurized liquid fuel;

an inlet adapted to supply the chamber with the pressurized liquid fuel; and a die tip, the walls of the die tip further defining at least one vestibular portion and at least one exit orifice, the at least one vestibular portion terminating in the at least one exit orifice, the vestibular being adapted to receive the pressurized liquid from the chamber and pass the liquid fuel to the exit orifice and out of the die housing; and a means for applying ultrasonic energy to a portion of the pressurized liquid fuel, the means for applying ultrasonic energy is affixed at a nodal point to the die housing and terminates in a distal end wherein the means for applying ultrasonic energy is located in close proximity to the vestibular portion and the distal end comprises a cross-sectional area equal to the opening of the vestibular portion;

exciting the means for applying ultrasonic energy with ultrasonic energy while the exit orifice receives pressurized liquid fuel from the chamber via the vestibular portion, without vibrating the die tip; and passing the pressurized liquid fuel out of the exit orifice whereby the liquid fuel particle size is minimized.

21. The method of claim 20, wherein the pressurized liquid fuel is injected into the internal combustion engine in the form of an atomized plume.

22. The method of claim 20, wherein the means for applying ultrasonic energy is located within the chamber.

23. The method of claim 20, wherein the means for applying ultrasonic energy is an immersed ultrasonic horn.

24. The method of claim 20, wherein the means for applying ultrasonic energy is an immersed magnetostrictive ultrasonic horn.

25. The method of claim 20, wherein the exit orifice is an exit capillary.

26. The method of claim 20, wherein the ultrasonic energy has a frequency of from about 15 Hz to about 500 kHz.

27. The method of claim 20, wherein the ultrasonic energy has a frequency of from about 15 kHz to about 60 kHz.

28. The method of claim 20, wherein the velocity of liquid fuel droplets is least about 25 percent greater than the velocity of identical pressurized liquid fuel droplets out of an identical die housing through an identical exit orifice in the absence of excitation by ultrasonic energy.

29. The method of claim 20, wherein the velocity of pressurized liquid fuel droplets is at least about 35 percent greater than the velocity of droplets of an identical pressurized liquid fuel out of an identical die housing through an identical exit orifice in the absence of excitation by ultrasonic energy.

30. The method of claim 20, wherein the Sauter mean diameter of pressurized liquid fuel droplets is at least about 5 percent smaller than the Sauter mean diameter of droplets of an identical pressurized liquid fuel out of an identical die housing through an identical exit orifice in the absence of excitation by ultrasonic energy.

31. The method of claim 20, wherein the Sauter mean diameter of pressurized liquid fuel droplets is at least about 50 percent smaller than the Sauter mean diameter of droplets of an identical pressurized liquid fuel out of an identical die housing through an identical exit orifice in the absence of excitation by ultrasonic energy.

32. A method of injecting a pressurized liquid fuel through an orifice, the method comprising:

supplying a pressurized liquid fuel to a die assembly composed of:

a die housing comprising:

a chamber adapted to receive a pressurized liquid fuel; the chamber having a first end and a second end;

an inlet adapted to supply the chamber with the pressurized liquid fuel; and a die tip, the die tip being located in the first end of the die housing, the walls of the die tip further define at least one vestibular portion and at least one exit orifice, the at least one vestibular portion terminating in the at least one exit orifice, the vestibular portion adapted to receive the pressurized liquid fuel from the chamber and pass the liquid fuel to the exit orifice and out of the die housing along a first axis; and an ultrasonic horn having a first end and a second end and adapted, upon excitation by ultrasonic energy, to have a node and a longitudinal mechanical excitation axis, the horn being affixed at the node to the die housing in a manner such that the first end of the horn is located outside of the chamber and the second end of the horn is located within the chamber and is in close proximity to the vestibular portion, the second end comprising a cross-sectional area equal to the opening of the vestibular portion;

exciting the ultrasonic horn with ultrasonic energy while the exit orifice receives pressurized liquid fuel from the chamber via the vestibular portion without vibrating the die tip, and passing the liquid fuel out of the exit orifice whereby the liquid fuel particle size is minimized.

33. The method of claim 32, wherein the exit orifice is an exit capillary.

34. The method of claim 32, wherein the ultrasonic energy has a frequency of from about 15 kHz to about 500 kHz.

* * * * *